United States Patent [19]

Hawkins

[11] Patent Number: 5,047,907

[45] Date of Patent: Sep. 10, 1991

[54] LEGEND DISPLAYING LIGHT FIXTURE WITH ENHANCED STRENGTH AND STRUCTURAL STABILITY

[75] Inventor: James W. Hawkins, Skokie, Ill.

[73] Assignee: Kenall Manufacturing Co., Gurnee, Ill.

[21] Appl. No.: 536,195

[22] Filed: Jun. 11, 1990

[51] Int. Cl.[5] ..... F21V 3/04

[52] U.S. Cl. ..... 362/311; 362/812; 40/570

[58] Field of Search ..... 362/31, 812, 311; 40/570, 575, 576, 594, 595

[56] References Cited

U.S. PATENT DOCUMENTS

| | | | |
|---|---|---|---|
| 1,915,236 | 6/1933 | Messner et al. | 40/575 |
| 3,854,229 | 12/1974 | Morgan | 40/594 |
| 4,355,479 | 10/1982 | Thornton | 40/570 |
| 4,385,343 | 5/1983 | Plumly | 362/31 |
| 4,967,317 | 10/1990 | Plumly | 362/31 |

*Primary Examiner*—Ira S. Lazarus
*Assistant Examiner*—Sue Hagarman
*Attorney, Agent, or Firm*—Michael G. Berkman

[57] ABSTRACT

An electrical lighting fixture of the "EXIT" sign type formed of a high-impact-strength, molded, substantially rigid plastics material including a transparent principal panel for viewing therethrough a flexible, translucent, light-diffusing sheet imprinted with an informative legend thereon. A perimetric, framing, marginal edge zone of the legend-carrying sheet is coated with a uniformly applied adhesive composition of even thickness. The latter constitutes means for firmly and securely bonding the sheet to the coextensive supporting panel of the fixture. The framing border of the panel, in registry with the adhesive-coated margin of the imprinted sheet, is preferably etched visually to shield the adhesive composition from view. A peelable, protective cover film overlies and is bonded, temporarily, to the legend carrying sheet for removal prior to fastening of the sheet in place on the panel.

5 Claims, 3 Drawing Sheets

LEGEND DISPLAYING LIGHT FIXTURE WITH ENHANCED STRENGTH AND STRUCTURAL STABILITY

BACKGROUND AND FIELD OF THE INVENTION

The present invention relates to a lighting fixture adapted for use in a high-abuse area such as schools, hotels, houses of correction, dormitories, gymnasiums and other places where fixtures are exposed to unintended as well as purposeful mistreatment or abuse. More particularly, the invention is directed to an "EXIT" sign type fixture especially fabricated to withstand and survive physical shock, impact and generally deleterious treatment.

Fixtures of the character in which the present invention finds utility are of the type which display indicia or illuminated legends as aids to identifying safe passageways or exit doors Such fixtures are used for insuring safe egress from a peopled area, particularly in the event of some emergency such as that posed by a fire.

While the critical importance of such fixtures has long been appreciated, and while extensive efforts have been made to design and fabricate fixtures for the role intended and which will be versatile and at the same time strong enough to withstand physical abuse, impact, and other mechanical shock, no completely satisfactory fixtures have heretofore been devised. Each suffers from one or more inadequacies or deficiencies. In some cases the physical arrangement of component elements limits or even precludes multiple optional uses, versatility or general adaptability for separate, yet functionally related, applications. In other fixtures, in which a selectable, physically-distinct specific sign sheet is used as a medium for carrying and presenting a desired legend to be displayed, the techniques and structures employed to retain the sheet immobile and properly oriented and in place within the fixture itself, have proven ineffectual. Such fixtures have been found incapable of withstanding the physical challenges posed, particularly in high-abuse areas. In still other fixtures of the prior art, the method used in assembly of the various component elements of the fixture have resulted in final products which lack or are seriously deficient in aesthetic appeal. Some of the fixtures have been unable to withstand the strains imposed by or related to broad ranges in ambient or environmental temperatures.

It is, therefore, a principal aim of the present invention to provide an improved fixture which obviates many of the shortcomings of prior art structures.

SUMMARY OF THE INVENTION

The present invention relates to a lighting fixture for displaying a legend viewed through a light permeable wall of the fixture. The legend is imprinted on a sheet of a thin, flexible plastics composition. The legend-carrying sheet is coated about its perimetric margin with a pressure-sensitive adhesive, and the entire expanse of the sheet is covered with a protective, peelable release film. In a preferred embodiment of the invention, the legend carrying sheet is scored in each of opposed side zones selectively, to facilitate the attachment of an additional legend or indicia, such as a direction-indicating arrow, to the legend-displaying sheet. The result is clearly to designate, for example, the proper exit direction, correlated with the particular physical location of the fixture in the environment.

The wall of the fixture on which the imprinted sheet is to be superimposed, is at least partially clouded or opacified at its marginal boundary by graining, roughening, or by other suitable techniques, so as to shield from view the adhesive-covered boundary on the legend-imprinted sheet. Thus the overall aesthetic appearance of the fixture is enhanced.

In a preferred embodiment of the invention, the adhesive itself is applied in a carefully controlled manner by resort to a screening or "silk-screening" technique in which applied pressure and other pertinent parameters are carefully regulated.

It is a feature of the invention that there is provided a legend-carrying sheet which is physically separate and distinct from the view-through wall of the lighting fixture, so that imprinted sheets carrying any of a series of selectable "messages" may be used, as required, for different applications in the same fixture structure.

A related feature of the invention is that the legend-carrying sheet is fabricated of a firm, yet thin and flexible plastics material, for example, of a polycarbonate or other plastic compositions which can be adhesively bonded to a principal wall of the fixture for viewing therethrough.

In a preferred embodiment of the invention, the legend-displaying sheet is precoated about its perimetric margin with a pressure-sensitive adhesive effective to bond the sheet to a view-through principal wall of the fixture, interiorly thereof.

It is a feature of the legend-carrying sheet of the invention that it possesses that degree of physical rigidity and stability which facilitates convenient handling and necessary manipulation when the sheet is lowered into the fixture and positioned in place against the fixture wall, to bond thereto.

It is a related important advantage of the legend-carrying sheet of the invention that its physical weight and mass are such that, when adhesively bonded to the supporting wall of the fixture housing, physical impact applied to the fixture itself will be ineffective to dislodge the bonded legend-carrying sheet from its established position.

It is a practical and utilitarian feature of the fixture itself that it may be used simultaneously to present messages readable from each of opposed principal sides of the fixture, rendering the fixture versatile in its application.

In one embodiment of the invention, the fixture is of a type concurrently attached to a wall or other vertical structure.

Yet another feature of the fixture of the invention is that its end walls are rendered opaque by means of a paint film or plastic applique applied thereto.

In a preferred embodiment of the invention, the base wall of the fixture and upper projecting soffit-like portions of the fixture are mechanically grained, roughened, or mottled to provide light diffusion and dispersion, and to shield lamps and other internal structures from sight.

It is a related feature of the fixture of the invention that a perimetric border zone framing the principal walls of the fixture is also grained, or otherwise somewhat opacified to shield the adhesive band which circumscribes the legend-carrying sheet from view.

Consistent with ensuring a high degree of resistance of the fixture to mechanical impact or shock, or other deleterious treatment, the fixture of the invention is preferably fabricated of a high-strength, shock-resistant material such as unitarily molded polycarbonate.

It is a related feature of the invention that physical parameters such as thickness and mass of the legend-carrying sheet are controlled to obviate mechanical displacement of, and separation of, the sheet from the fixture wall should impact forces be applied thereto.

Other and further objects and advantages and features of the invention will be understood from the following detailed description considered in conjunction with the drawings.

DESCRIPTION OF ILLUSTRATED EMBODIMENT

The aims and objects of the invention are achieved by providing, in a lighting fixture of the "EXIT" sign type, a high-impact-strength, unitary, molded housing of shock-resistant, substantially-rigid plastics composition. The housing includes a pair of opposed transparent view-through walls integrally joined to one another, opaque end walls, and soffit-like flanges by which the housing is mountable to depend from an overhead surface.

A thin, self-supporting, semi-rigid yet flexible transparent sheet of plastics material, imprinted with a legend or indicia to be displayed through the transparent walls of the fixture, is coated about its perimetric margin with a pressure-sensitive adhesive. A peelable release film protects the adhesive prior to positioning the sheet in its operative disposition in the fixture. As so placed, the sheet is disposed against the wall of the fixture on an inner surface thereof. In a preferred embodiment of the invention, the base of the housing is roughened or mottled to diffuse light and to shield the interior of the housing from view. A similar surface finish is formed on the marginal periphery of the principal walls of the fixture to mask the adhesive carried by the legend sheet.

Figure 1:
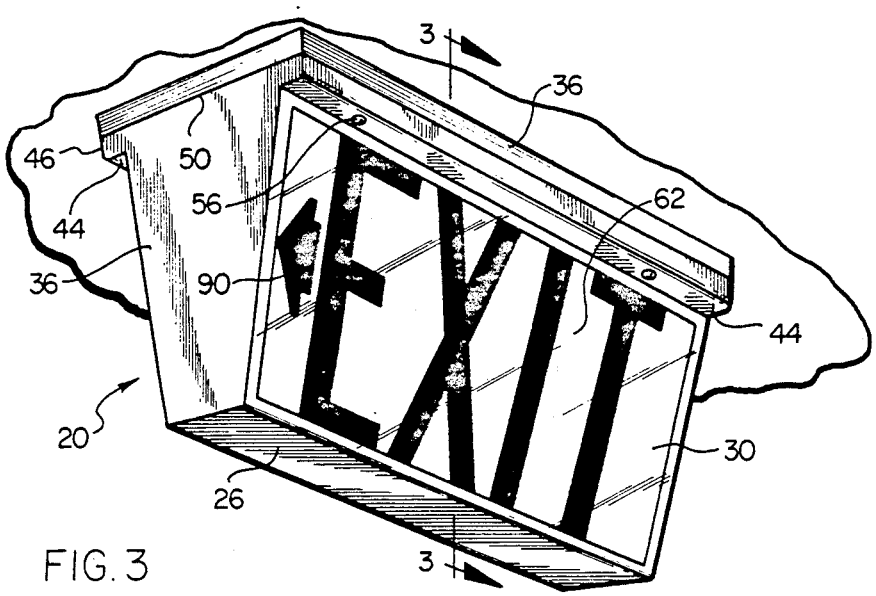
FIG. 1 is a perspective view of a lighting fixture, in accordance with the present invention, embodying the features thereof.

Referring now to the drawings, there is shown one preferred embodiment of the light fixture of the invention provided for illustrative purposes and not to be construed in any limiting sense. The high-abuse area fixture 20, as shown in FIGS. 1 and 2, defines a generally trough-shaped body or housing 24 having a base 26, a pair of upwardly and outwardly pitched principal walls 30 and 32, and a pair of end walls 36 and 38.

Figure 3:
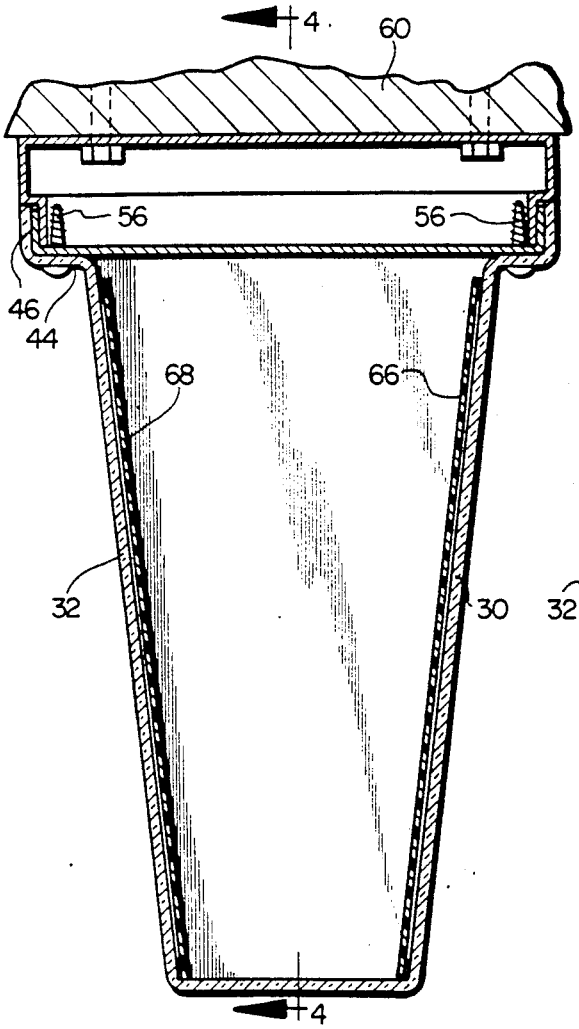
FIG. 3 is an enlarged, cross-sectional view taken substantially on the lines 3—3 of FIG. 1.
Figure 4:
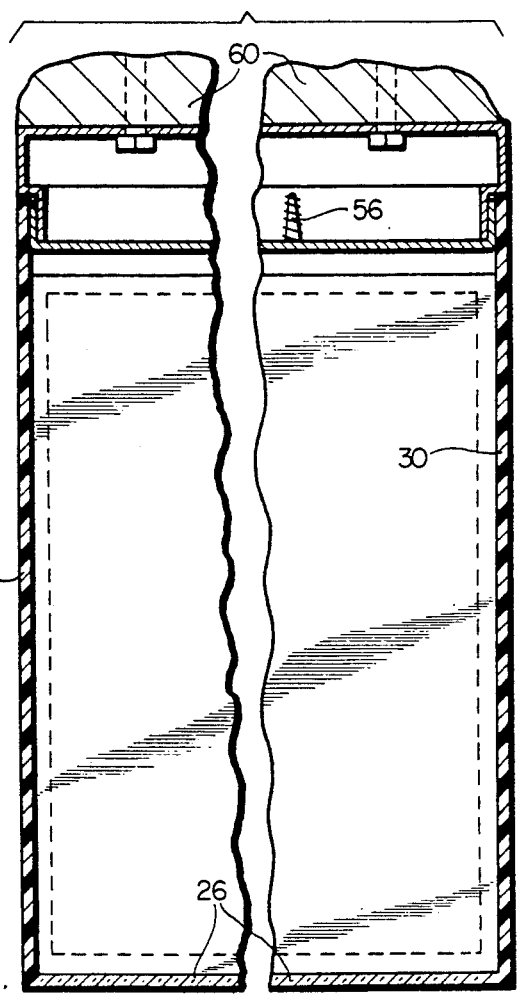
FIG. 4 is a cross-sectional view, with parts cut away, taken substantially on the lines 4—4 of FIG. 3.

The walls 30 and 32 are integral with the housing 24 and define a horizontally extending ledge 44 terminating in an upwardly projecting flange 46, a top edge of which is coplanar with an upper edge 50 of the end walls 36 and 38. In a preferred embodiment of the invention, the horizontally extending ledges 44 are predrilled 54 to facilitate insertion of fixture-mounting screws 56 (FIG. 3) for securing the fixture 20 to a ceiling 60, or other overhead structure.

In accordance with the principles of the present invention, the legend 62 or other indicia, such as "EXIT" is not imprinted upon or otherwise an integral element of the "display" walls 30 and 32 of the fixture 20. As best shown in FIG. 2, it is an important feature of the invention that there is provided a separate legend-carrying panel(s) 66 and 68 on which the intended legend 62 or "message" is printed, screened, or stenciled or otherwise affixed. The panel 66 is fabricated of a thin and flexible, yet self-supporting composition such as polycarbonate or plastics composition. Preferably, the surface 68 of the panel 66 has been rendered translucent 70 by graining or mottling or other suitable technique or expedient. A perimetric marginal zone 72 framing the panel 66 is coated with a thin, film-like bead or band of a pressure-sensitive adhesive composition 74 applied, using a carefully controlled silk-screen deposition technique. A peelable protecting release sheet 78 is then affixed to cover and protect the adhesive-coated panel 66.

Figure 2:
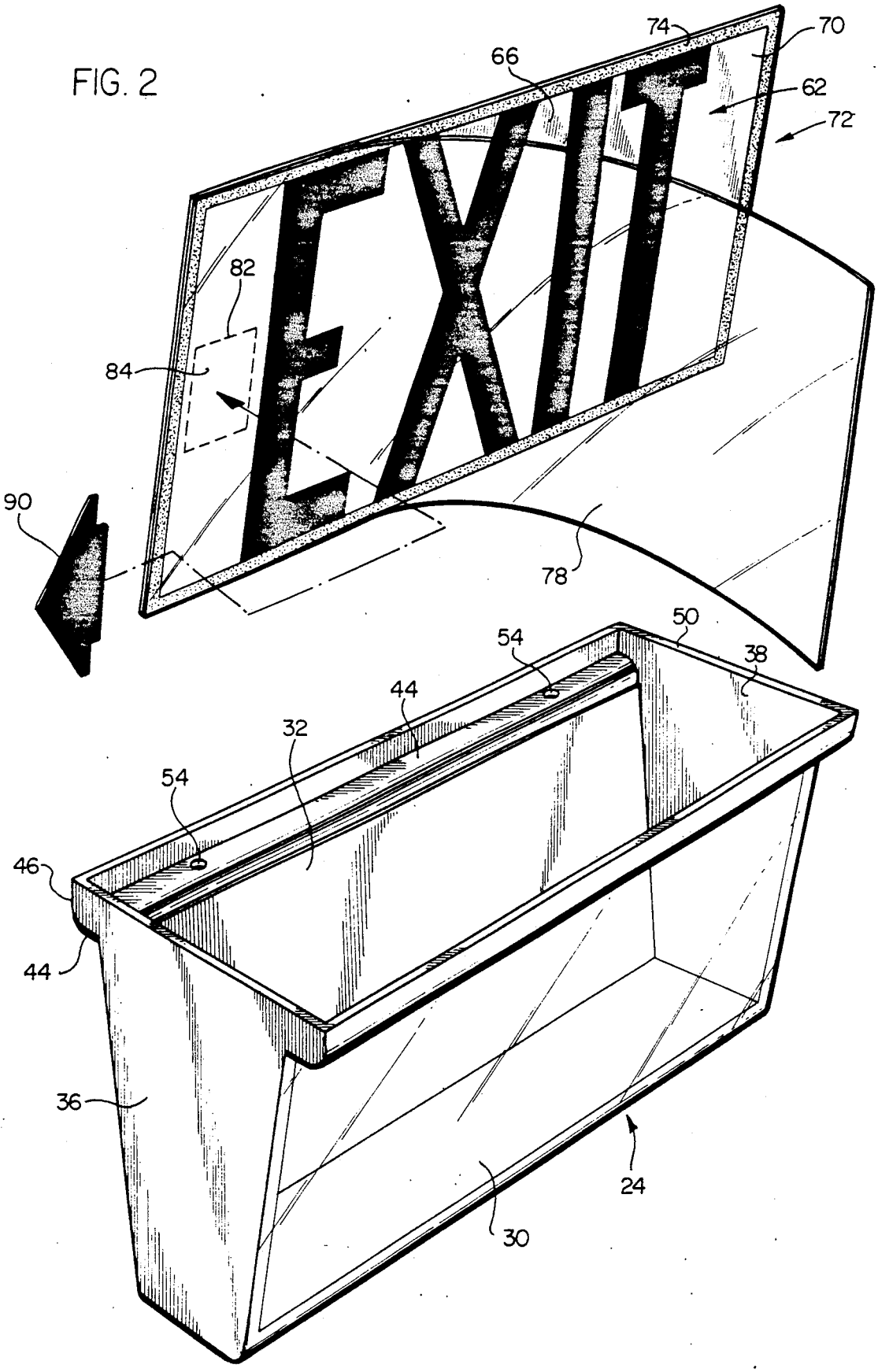
FIG. 2 is an enlarged, exploded view of the fixture of FIG. 1, depicting the components thereof, and indicating schematically the manner in which a protective film is removed from the legend-displaying panel prior to bonding the panel, adhesively, to the wall of the fixture, interiorly thereof.

As shown in FIG. 2, the legend-carrying sheet 66 is scored 82 in each of opposed laterally disposed end zones to form windows 84. After peeling the release film 78 from the panel 66, a supplemental legend or other indicia 90, such as an arrow, may then be adhesively bonded in place to designate, for example, the correct EXIT direction for the particular orientational zone in which the fixture 20 is used. The adhesive-bordered panel 66 is carefully inserted into the trough-like housing 24, and pressed against the wall 30 (or 32) to bond thereto as shown in FIG. 1.

In the specific preferred embodiment shown in FIGS. 1-4, the bordering margins of the walls 30 and 32 are grained 94 or otherwise reduced in transparency so as to shield from view the adhesive 70 carried by the panel or panels 66 and 68. The effect achieved is to enhance and render the overall appearance of the assembly aesthetically more pleasing.

Figure 5:
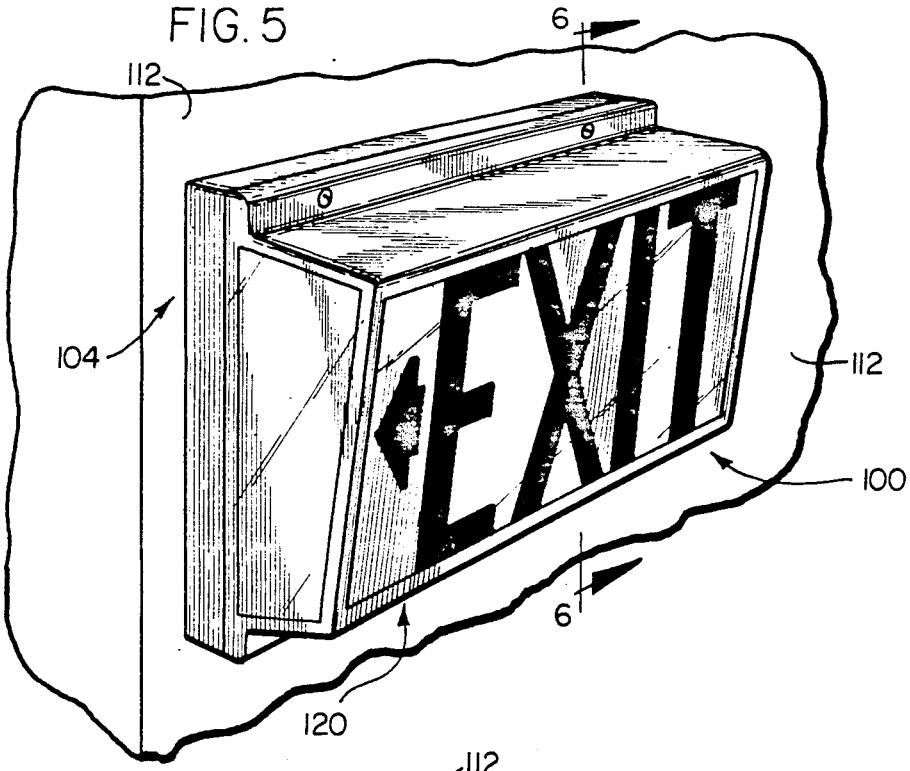
FIG. 5 is a perspective view of a second embodiment of a lighting fixture, for mounting on a wall or other vertical support structure.
Figure 6:
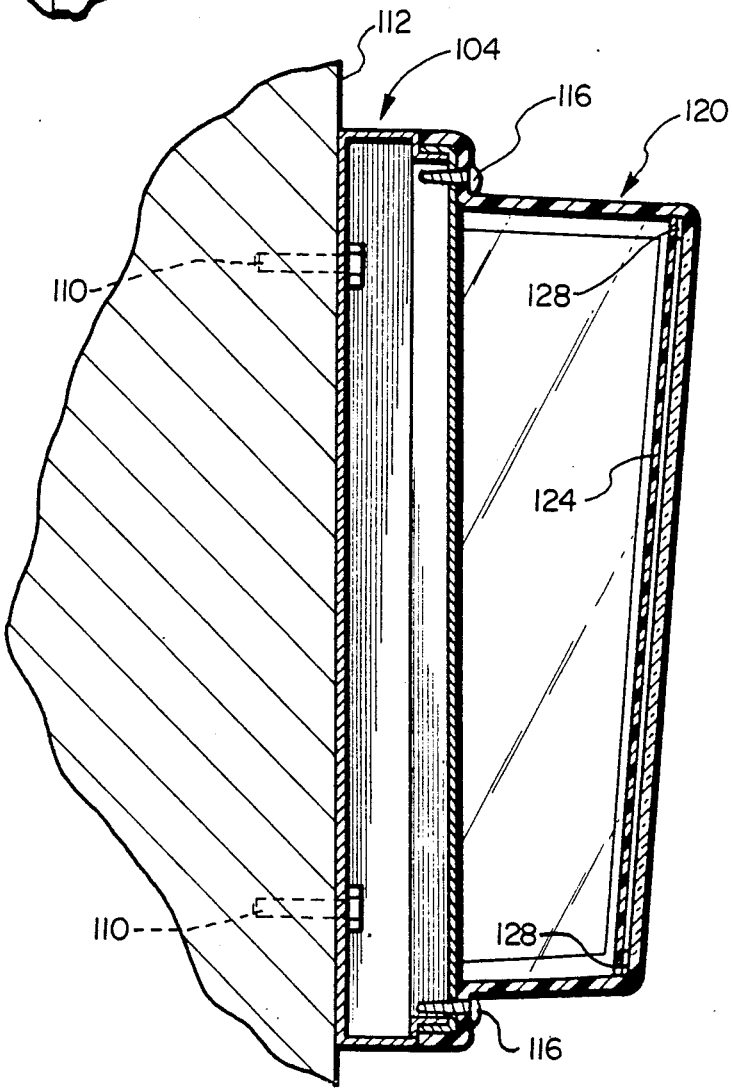
FIG. 6 is a cross-sectional view taken substantially on the lines 6—6 of FIG. 5.

Referring now to FIGS. 5 and 6, there is shown an embodiment of the invention which is adapted for mounting on a vertical wall or related support structure. The fixture 100 includes a mounting frame 104 having a back plate 106 which is attached by means of screws 110 to a supporting wall 112. Secured to the mounting frame 104 by means of screw fasteners 116 is a plastic shell or housing 120 which sealingly abuts the frame 104. In other material respects, elements of the structure, including the legend-carrying panel 124 and the panel-holding adhesive 128 are the same as that described with reference to the first described embodiment of the invention.

While preferred embodiments of the invention have been illustrated and described, other variations may be made utilizing the inventive concepts herein disclosed. It is intended that all such variations in functional structures and in compositions be considered as within the scope of the invention, as defined in the following claims.

What is claimed is:

1. In a legend-displaying electrical fixture including a frameless, unitary housing of plastic composition, and illumination means, said housing been devoid of metallic framing elements and having a light-pervious principal wall of transparent plastics material presented for viewing a legend therethrough, a fixture-housed, legend-imprinted panel means displaying said legend for viewing through said wall, said light-pervious panel means being essentially co-continuous with said wall, fastening means for securing said legend-imprinted panel means within said housing to overlie said light-pervious wall in substantially contiguous abutment with a surface of said wall disposed interiorly of said housing, the improvement wherein said housing defines a unitary structure of plastics composition devoid of auxiliary framing elements, wherein said panel means is a thin, flexible sheet of plastics composition, and wherein said fastening means comprises adhesive means in the form of a pre-deposited, film-like web of substantially uniform thickness overlying and circumscribing said panel means in a perimetric marginal band thereabout for securely bonding said panel means to said wall on an inner face thereof, physically generated, etched, band-like border means formed integrally on said light transmitting wall along perimetric margins thereof for visually and unobtrusively shielding said band of adhesive from view and for aesthetically enhancing the appearance of said unitary housing of said fixture, and wherein said panel means is characterized by limited, controlled rigidity coupled with a high degree of flexibility.

2. The structure as set forth in claim 1 wherein said film-like web is a composition applied to said panel through a thickness-controlling screening technique, and further comprising a peelable protective release sheet overlying said panel means and temporarily bonded thereto as a protective covering therefor, said release sheet being readily removable prior to installation of said panel means in said fixture.

3. The structure as set forth in claim 1 wherein said panel means includes zones at either side of a legend carried on said panel means for selective use to indicate a safe exit direction.

4. The structure as set forth in claim 1 wherein said panel means includes a light-diffusing surface.

5. The structure as set forth in claim 1 and further comprising a peelable protective release sheet overlying said panel means and temporarily bonded thereto as a protective covering therefor, said release sheet being readily removable prior to installation of said panel means in said fixture.

* * * * *